US005566665A

United States Patent [19]

Stinson

[11] Patent Number: 5,566,665

[45] Date of Patent: Oct. 22, 1996

[54] METHOD AND APPARATUS FOR MOUNTING ARCHERY QUIVERS AND THE LIKE ON ARCHERY BOWS

[76] Inventor: Robert E. Stinson, 7292 Peaceful Valley Rd., Acme, Mich. 49610

[21] Appl. No.: 326,760

[22] Filed: Oct. 20, 1994

[51] Int. Cl.[6] ..... F41B 5/06

[52] U.S. Cl. ..... 124/86; 124/25.7

[58] Field of Search ..... 124/23.1, 25.5, 124/25.6, 25.7, 86, 87, 88

[56] References Cited

U.S. PATENT DOCUMENTS

| | | | |
|---|---|---|---|
| D. 248,040 | 5/1978 | Stinson | D22/13 |
| D. 295,655 | 5/1988 | Stinson | D22/107 |
| 2,802,611 | 8/1957 | Jenkins et al. | 124/23.1 |
| 4,156,496 | 5/1979 | Stinson . | |
| 4,788,961 | 12/1988 | Toth | 124/25.5 |
| 4,794,800 | 1/1989 | Stinson | 33/265 |
| 4,805,584 | 2/1989 | Stinson | 124/86 |
| 5,076,522 | 12/1991 | Stinson | 248/216.1 |
| 5,123,396 | 6/1992 | Shepley et al. | 124/25.5 |

OTHER PUBLICATIONS

Exhibit A discloses three bows and bow-mounted quivers made by Kwikee Kwiver, the assignee of the present invention, which items are in prior art.

Exhibit B discloses various bow sites as disclosed in a catalog published by Cabela's on p. 209, the catalog being published in the fall of 1993 and being publicly distributed before the filing of this application, the author being unknown.

*Primary Examiner*—John A. Ricci

*Attorney, Agent, or Firm*—Price, Heneveld, Cooper, DeWitt & Litton

[57] ABSTRACT

A mount is provided for mounting a quiver to a bow for optimal mass positioning and distribution, to dynamically balance the bow and quiver combination. The mount includes an elongated extension plate which is attached to the side of the bow handle riser and includes an offset longitudinal configuration, with a releasable attachment device for the quiver disposed outwardly from the bow. The offset configuration positions the quiver close to the plane in which the bowstring moves when shooting an arrow, so that the bow and quiver assembly have an optimum mass distribution that is dynamically balanced and thus minimizes vibration and torque forces acting on the bow when an arrow is shot, thus improving accuracy and shooting comfort of the bow.

16 Claims, 5 Drawing Sheets

METHOD AND APPARATUS FOR MOUNTING ARCHERY QUIVERS AND THE LIKE ON ARCHERY BOWS

BACKGROUND OF THE INVENTION

This invention relates to a method and apparatus for mounting quivers and the like on archery bows, and more particularly to a mounting structure and method for improved positioning of an arrow quiver relative to an archery bow, whereby significantly improved dynamic balancing effects are unexpectedly obtained.

Arrow quivers are often mounted directly on archery bows by attaching them to the handle riser portion of the bow, and they are also sometimes mounted on cable guards and/or various dovetail sight blocks attached to the handle riser of the bow. Known arrangements position the arrow quiver at a substantial lateral distance from the central plane defined by the bow and bow-string. The reason for this is, apparently, so that the arrow quiver will not interfere with drawing, aiming or shooting an arrow. Unfortunately, as the present inventor has now discovered, this creates a dynamically unstable distribution of mass that causes the bow to vibrate and torque when shooting an arrow, thus reducing the accuracy of the shot. People skilled in the art have not appreciated the adverse effects of bow-mounted quivers on shooting accuracy, and specifically have failed to realize the dynamically unstable conditions so created, and the resulting reduced shooting accuracy.

SUMMARY OF THE INVENTION

To solve the above noted problems, the present invention provides a mount for a quiver having an offset configuration which locates the quiver and the quiver mounting bracket on or significantly nearer the central plane of the bow, the central plane being defined by the bow and bowstring. This provides a much more dynamically balanced arrangement that is more stable and thus substantially reduces vibration and torque when an arrow is shot.

In one aspect of the present invention, a new type of mount is provided for attaching a quiver to a bow. The bow includes a handle disposed between extending limbs, and a bowstring operably connected between the free ends of the limbs, the limbs and string defining a central plane on the bow in which the arrow is propelled. The mount includes an extension having a first end configured for attachment to the bow handle, and further having a second end spaced from the first end. The second end includes means for securely attaching the quiver. The extension is configured so that the second end is located closer to the central plane of the bow string than the first end, whereby the quiver can be secured to the bow handle in a balanced position to facilitate a smoother release and more accurate shot. In the preferred embodiment, the bow quiver is positioned closer to the central plane than if the quiver had been mounted on the side of the bow handle itself, and is preferably positioned immediately adjacent to but not actually in the central plane of the bow and string, thus avoiding interfering with the movement of the bowstring in such plane while still providing a balanced arrangement.

These and other features, advantages and objects of the present invention will be further understood and appreciated by those skilled in the art by reference to the following specification, claims and appended drawings which disclose certain preferred embodiments.

DESCRIPTION OF PRIOR ART

Figure 1:
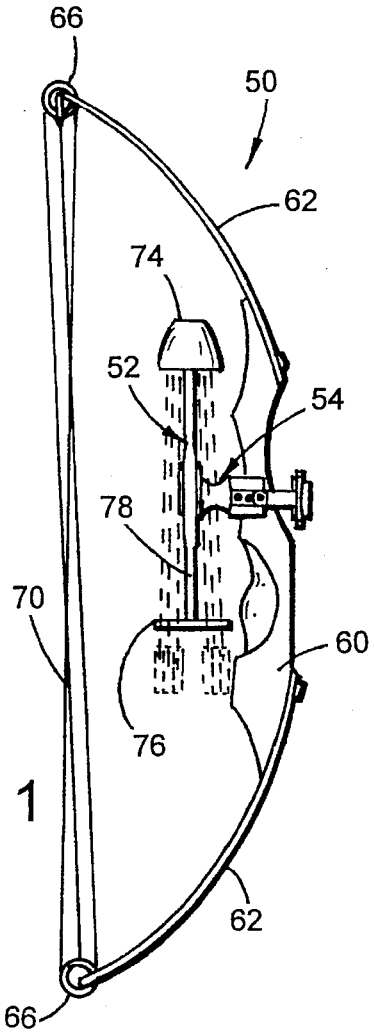
FIG. 1 is a generalized and simplified side view schematic representation of a bow and quiver interconnected by a mount embodying the present invention.

A very basic prior art arrangement for mounting an arrow-holding quiver upon an archery bow is shown in FIGS. 10–13 inclusive. The bow 10, quiver 12, and releasable connector 14 of these figures are described in detail in my U.S. Pat. No. 4,156,496, and thus a detailed description here is not necessary. However, briefly it is noted that connector 14 includes a block-like base 16 attached to the side of bow handle 18. Base 16 defines an elongated tapered slot 22 (FIG. 13), and quiver 12 includes an elongated central support member having an integral connector blade 24 adapted to mateably engage slot 22. Base 16 further includes a latching member 26 (FIGS. 10 and 12) which is spring-biased by a leaf spring 28 to a position located over the end of slot 22. Quiver 12 is releasably securable to bow 10 by inserting connector blade 24 into slot 22 after which latching member 26 is released. This attachment provides secure but detachable mounting of the quiver on the bow without the use of other components or separate fasteners.

Figure 14:
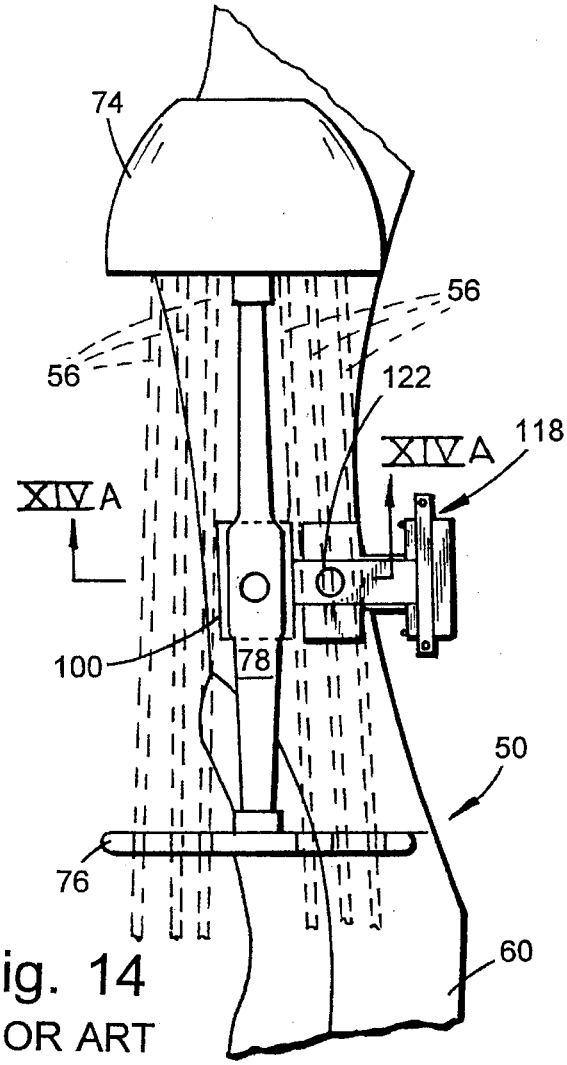
Fig. 14 PRIOR ART
FIG. 14 is a fragmentary side view showing a quiver mounted on a bow by use of a dovetail sight mount pursuant to prior art practice; and FIG. **14*a* is an enlarged sectional view taken along the plane XIVA—XIVA of FIG. 14**.
Figure 14A:
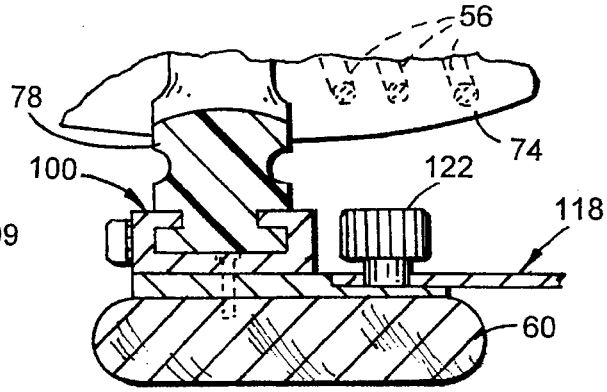
Fig. 14A PRIOR ART
Figure 9:
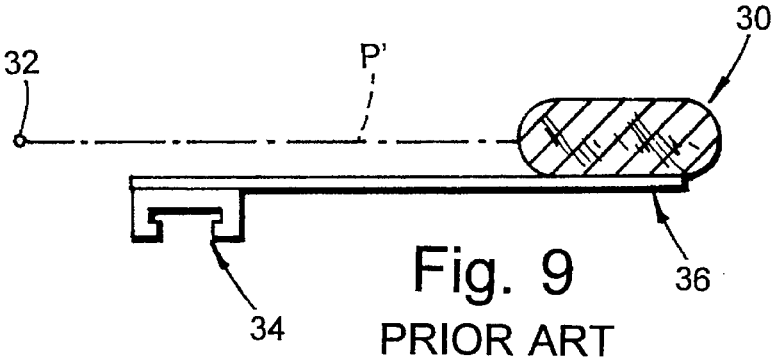
Fig. 9 PRIOR ART
FIG. 9 is a schematic illustration of a bow and a planar quiver mounting bracket of the prior art.

The prior art also includes various other ways of mounting such a quiver on a bow, some of which included intermediate members which positioned the quiver somewhat behind the bow. One such arrangement is schematically represented in FIG. 9 by a bow 30 including a bow string 32, and a quiver 34 attached to bow 30 by an extension 36. The extension 36 is a flat and planar member that attaches to the side of bow 30 and extends rearwardly. Quiver 34 is secured to an exterior side of extension 36 so that quiver 34 is positioned well away from a central plane P' defined by bow 30 and string 32. Other known ways to mount a quiver on a bow use the typical mounting plate provided for dovetail sights, as generally shown in FIGS. 14 and 14A, which produces an offset alignment of the quiver with respect to the bow which is much like that shown in FIG. 9, although the quiver is closer to the bow or generally adjacent it, in such an arrangement.

I have observed that the conventional quiver-mount arrangements illustrated in FIGS. 9–14 produce an unsatisfactory result since, when arrows are shot from the bows, the force generated by the bow along the thrust plane P produces a torsional kick due to the dynamically unbalanced position of the quiver, which is offset laterally from the plane of the bow and bowstring and thus represents an off-axis mass concentration with respect to the central plane P' of the bow. In addition, mounting arrangements like that shown in FIG. 14 usually result in the arrows 56 being positioned with their shafts overlying the sight-adjustment knob 122, making it cumbersome and difficult to change the position of the bow-sight since requiring arrow removal.

DETAILED DESCRIPTION OF THE PREFERRED EMBODIMENT

Figure 2A:
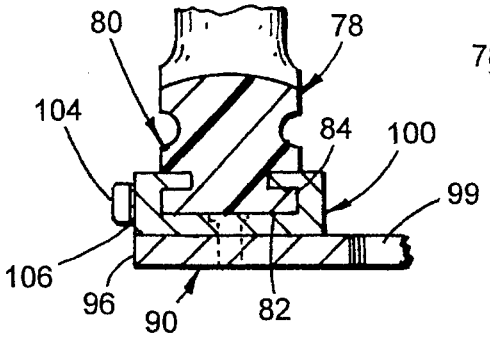
FIG. 2A is a cross section taken along the plane IIA—IIA of FIG. 2.
Figure 2:
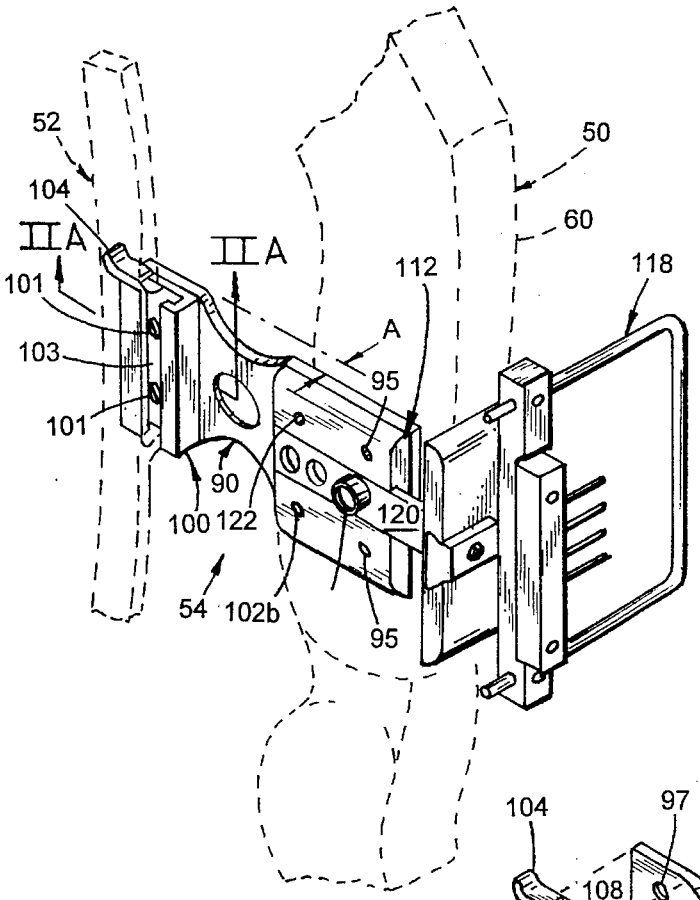
FIG. 2 is an enlarged perspective view of the mount with a bowsight attached thereto, adjacent portions of the bow and quiver being shown in phantom.
Figure 8:
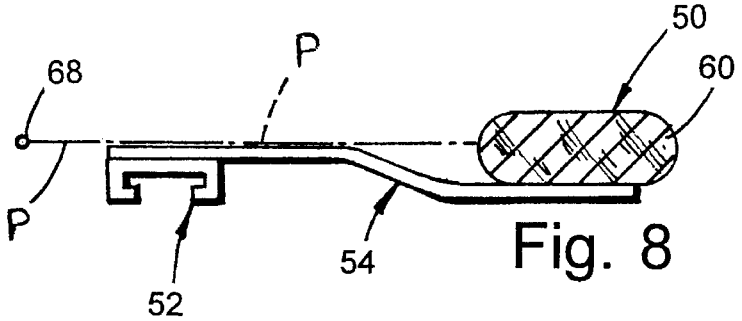
FIG. 8 is a schematic illustration of the mount and bow shown in FIGS. 1 and 2.
Figure 10:
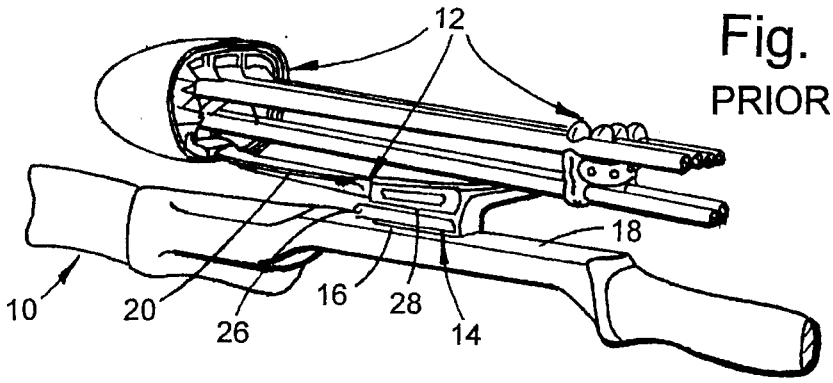
Fig. 10 PRIOR ART
FIG. 10 is a perspective view of a bow and quiver of prior art, the quiver being mounted directly to the handle of the bow.
Figure 11:
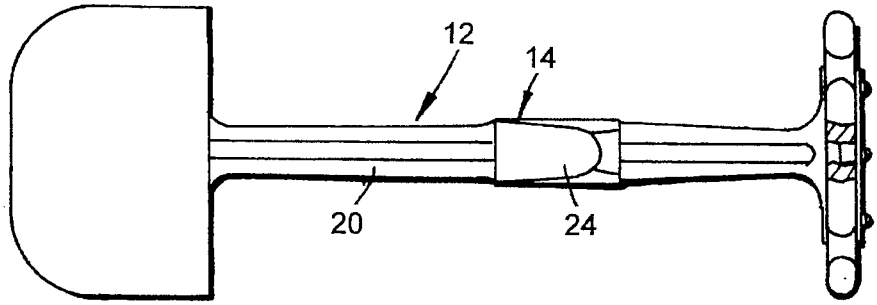
Fig. 11 PRIOR ART
FIGS. 11–12 are side and front views of the bow and quiver of prior art shown in FIG. 10.
Figure 12:
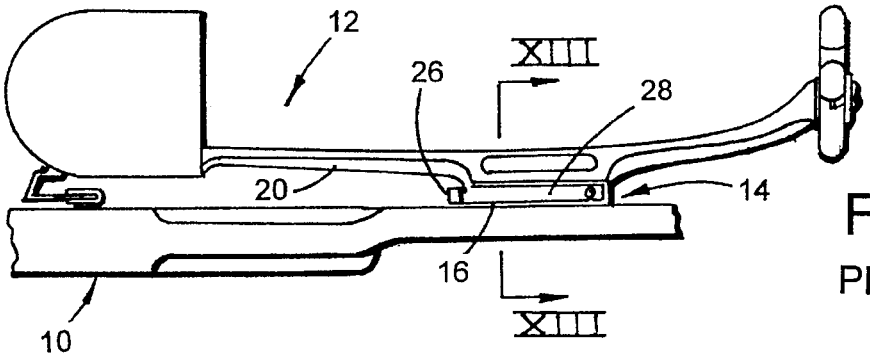
Fig. 12 PRIOR ART
Figure 13:
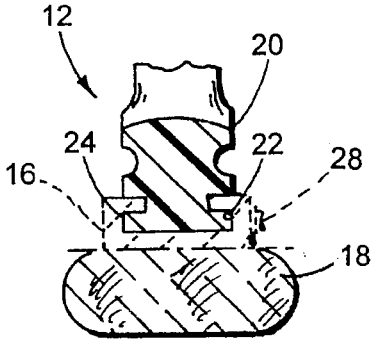
Fig. 13 PRIOR ART
FIG. 13 is a cross-sectional view taken along the plane XIII—XIII in FIG. 12.

An apparatus (FIGS. 1 and 2) embodying the present invention includes a bow 50, a quiver 52 which is preferably like quivers of FIGS. 10–12, and a mount 54 for mounting quiver 52 in an optimal and balanced condition on bow 50. In particular, mount 54 positions quiver 52 generally behind bow 50 and close to the central plane P defined by bowstring 68 and the centerline of bow 50 (FIG. 8). By mounting quiver 52 in this manner, quiver 52 is close to being dynamically balanced, since the mass distribution is much more evenly positioned with respect to central plane P. Consequently, bow 50 does not vibrate and torque unacceptably when an arrow is shot.

The illustrated bow 50 (FIG. 1) is a compound bow, having a handle 60 and upper and lower limbs 62 extending from handle 60; the ends 64 of limbs 62 including roller cams 66. Bowstring 68 is anchored to ends 64 and extends around rollers 66. An arrow (not shown) can be engaged with the center section 70 of string 68 so that when string center section 70 is drawn and then released, the limbs 62 resiliently straighten, causing the arrow to be propelled forwardly. It is the movement of center section 70 of string 68 in combination with bow 50 that defines central plane P (FIG. 8).

The details of quiver 52 are disclosed and discussed in detail in my U.S. Pat. No. 4,156,496 which issued May 29, 1979 entitled BOW-MOUNTED ARROW QUIVER, the entire contents of which are incorporated hereinafter by reference. Briefly, quiver 52 includes an arrowhead-receiving shield 74 and a shaft-gripping arrow holder 76, both mounted on and supported by an elongated longitudinal rib member 78. Quiver rib 78 includes an integral mounting structure 80 (FIG. 2A) midway along its length like connector 14 of quiver 12 (FIGS. 11 and 13), having a blade like near member 82 with side flanges 84 and an arcuately shaped leading end for engaging a correspondingly shaped slot in the mating connector 100 which is attached to mount 54 as described hereinafter.

Figure 3:
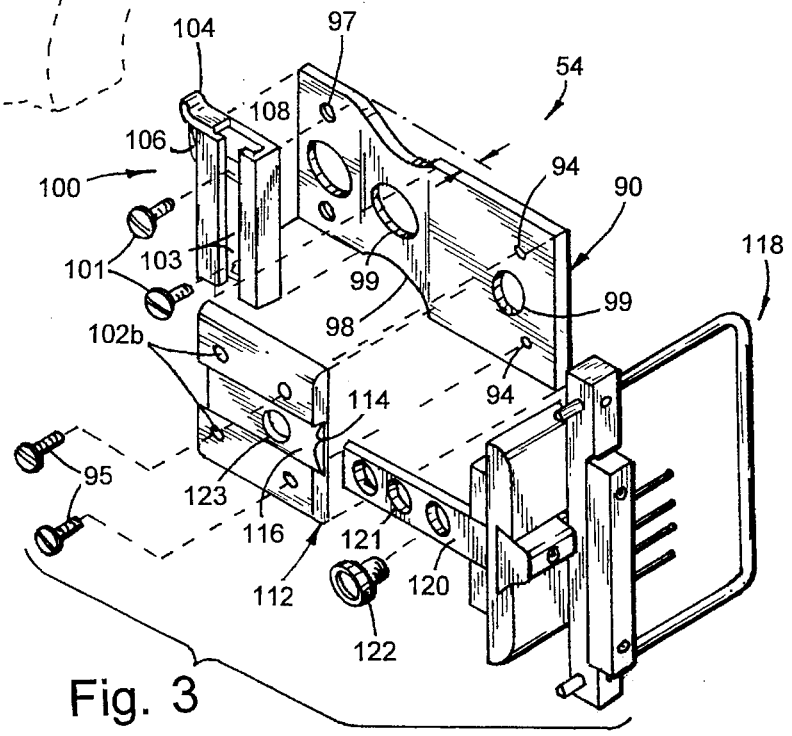
FIG. 3 is an exploded perspective view of the mount, and a mounted bowsight.
Figure 5:
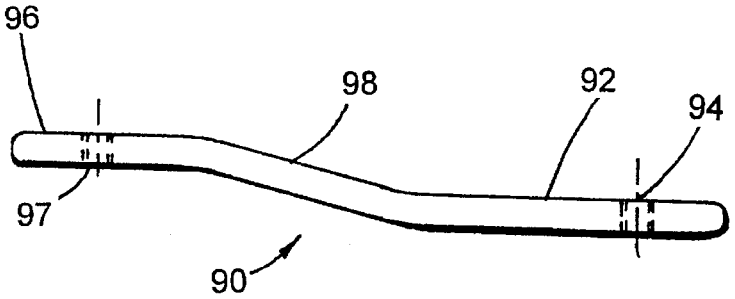
FIG. 5 is a top view of the extension bracket shown in FIG. 4.
Figure 4:
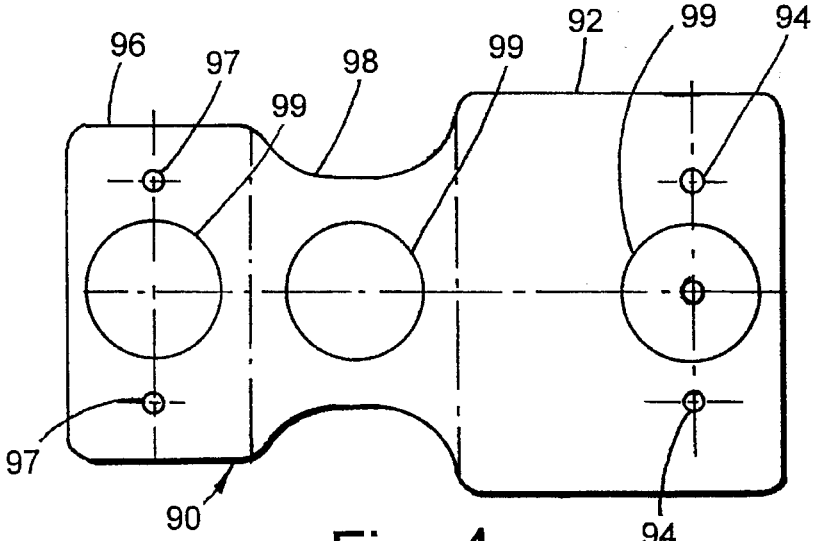
FIG. 4 is a side view of the extension bracket used in the mount.
Figure 6:
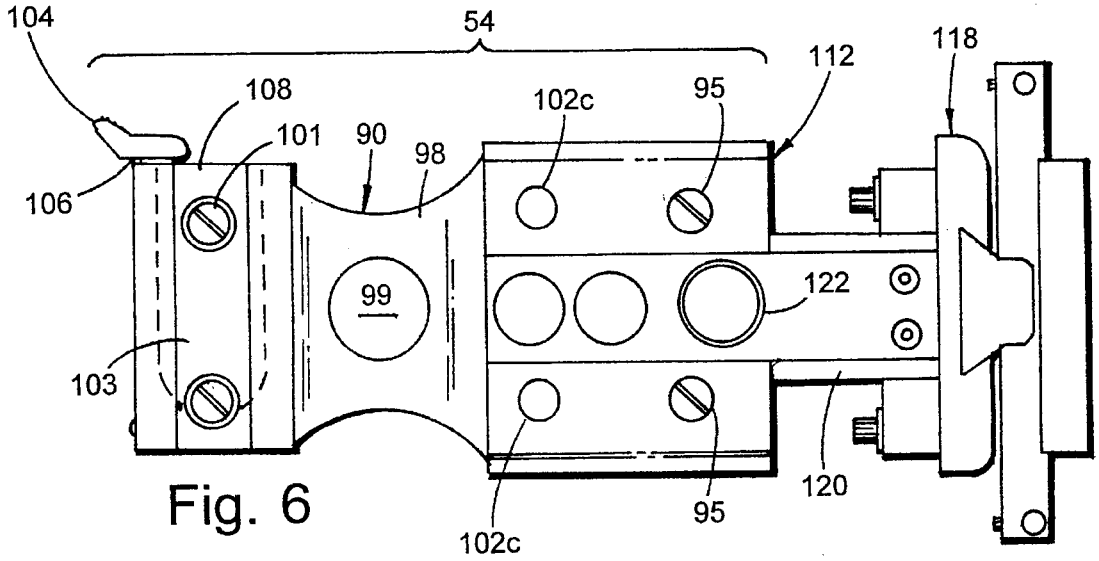
FIG. 6 is a side view of the mount shown in FIG. 2.
Figure 7:
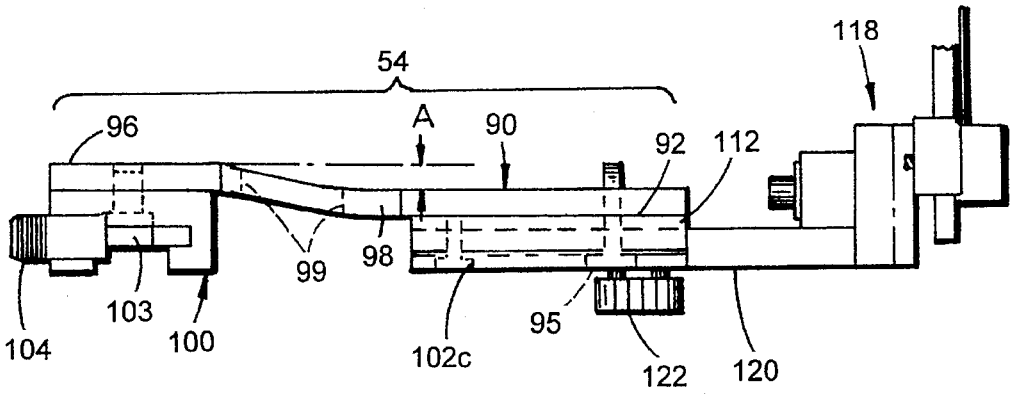
FIG. 7 is a top view of the mount shown in FIG. 6.

Mount 54 (FIGS. 3–7) includes an extension plate or bracket 90 having a bow handle-engaging first end 92 with a pair of spaced holes 94 for receiving screws 95 for mounting extension plate 90 to the side of bow handle 60. Mounting plate 90 further includes a quiver-supporting second end 96 with a pair of spaced holes 97. An intermediate section 98 connects ends 92 and 96 together, and intermediate section 98 has a curved or angular laterally offset configuration (FIGS. 5 and 7), to displace ends 92 and 96 laterally from one another a distance represented by the dimension "A" shown in FIGS. 2, 3 and 7. As will be understood, the specific value of dimension "A" will or may vary from one particular situation to another, but in most instances this value will be on the order of from one-fourth to three-eights of an inch. The relationship to be obtained, as noted above, is to have extension plate 90 secured to bow handle 60 in operative position with the quiver-supporting end 96 of extension plate 90 positioned sufficiently close to central plane P, (FIG. 8), so that as bowstring 68 is drawn back, its center section 70 moves proximate to but does not interferingly contact a quiver mounted on the quiver-supporting end 96 (FIG. 8). Apertures 99 (FIG. 3) are placed in extension plate 90 as desired to reduce mass and weight.

Mount 54 (FIG. 3), is preferably configured to carry one of the quick-connect, quick-disconnect quiver-mounting members 100 by attachment thereof to extension plate 90. The quiver-mounting members 100, are preferably of the same type as the connectors 14 noted above (FIGS. 10–13 inclusive), and they may be secured to extension plate 90 by countersunk screws 101, 102A. Each such member 100 includes opposing front flanges defining a recess 103 (FIGS. 2 and 3) configured to mateably receive the tapered mounting blade 82 (FIG. 2A) of quiver 52 (which is essentially the same as blade 24 of quiver 12, described in connection with FIGS. 11 and 13). With quiver 52 mounted in member 100, the mass of quiver 52 is positioned as close as possible to central plane P and generally behind bow handle 60, so that a minimum torque "kick" is generated on bow 50 when an arrow is released (FIG. 8).

A slotted plate-like connector 112 (FIG. 3) is illustrated as also secured to the bow handle-engaging end 92 of mount 54, to clamp the latter against the bow handle. Slotted member 112 is actually a mounting block for the dovetail bowsight 118, and includes a pair of angularly opposing shoulders 114 forming a dovetail slot 116 between them. A bow sight 118 of a conventional nature includes a dovetailed mounting leg 120 shaped to matingly and telescopingly engage shoulders 114 of slot 116. A set-screw 122 is extended through one or another of a series of adjustment holes 121 in leg 120 and engages with a depression 123 in slotted standoff 112, to hold bowsight 118 in a desired mounted position. Connector plate 112 conventionally has a second set of apertures **102*b* which may optionally be used to augment the mounting thereof upon the bow handle and/or mount q quiver in the manner shown in FIGS. 14 and 14A. These apertures 102*b* are not necessarily used in accordance with the present invention, but they may be used if desired by providing a pair of registering holes 102C in mount plate 54, as shown for example in FIGS. 6 and 7**.

Accordingly, it can be seen that the unique mount for mounting a quiver to a bow in accordance with the present invention securely supports the quiver in a dynamically balanced position relative to on the bow and bowstring, thus resulting in substantially reduced vibration and improved accuracy when shooting the bow. It is expressly intended, however, that the above description should merely be considered as that of a particular, preferred embodiment, since the underlying concept may be implemented by various different particular types and arrangements of elements and components. The true spirit and scope of the present invention should therefore be determined by reference to the appended claims, according the terms thereof the broadest reasonable meaning.

The embodiments of the invention in which an exclusive property or privilege is claimed are defined as follows:

1. A mounting apparatus for attaching a quiver to a bow, the bow including a handle and a bowstring operably connected to the bow to define a central thrust plane when shooting an arrow, said mount comprising:

an extension member including a first end configured for attachment to the bow handle, and further including a second end spaced from said first end, a quiver-attachment mount at said second end, said extension member being configured such that said second end is located closer to said central plane of said bow than said first end, whereby a quiver mounted on said attachment mount is disposed in a position of enhanced dynamic balance relative to said thrust plane to minimize torsional kick produced by off-plane masses.

2. A mount as defined in claim 1 wherein said extension member includes an intermediate section connecting said first and second ends, said intermediate section being formed to offset said first end from said second end relative to said plane.

3. A mount as defined in claim 2 wherein said second end is offset a distance such that the quiver is located closer to said plane than if the quiver was mounted directly to a side of the handle.

4. A mount as defined in claim 2 wherein said quiver-attachment mount includes a manually releasable latch to release or retain the quiver in place.

5. A mount as defined in claim 4 and further including a bowsight attachment.

6. A mount as defined in claim 5 wherein said bowsight attachment includes a member securable to said first end, said member including a recess for receiving a mounting portion of said sight.

7. A mount as defined in claim 1 wherein said extension member is reversible for use by either a left-handed archer or a right-handed archer.

8. An archery apparatus comprising:

an archery bow including a handle, resilient limbs extending from said handle and a bowstring operably mounted on said limbs, said bowstring and bow defining a force plane for shooting an arrow;

a quiver and a quiver-mounting structure; and an extension attached to said handle at a point of mutual contact, said extension including a portion to secure said quiver-mounting structure on said extension at a location spaced from said handle, said extension having a configuration to position said portion to secure said quiver-mounting structure at a location generally behind said bow handle and more closely proximate to said force plane than said point of mutual contact between said extension and said handle.

9. An archery apparatus as defined in claim 8 wherein said extension includes an elongated member having opposing ends connected by an intermediate section that locates one of the opposing ends laterally offset relative to the other of the opposing ends with respect to said force plane.

10. An apparatus as defined in claim 9, wherein said quiver is releasably attached to said quiver-mounting structure and positioned thereby proximate to said force plane.

11. An apparatus as defined in claim 8 including a bowsight, said extension including a mount for said sight.

12. An apparatus as defined in claim 8 wherein said extension is reversible for use by both left-handed and right-handed archers.

13. A method of dynamically balancing an archery bow and a quiver carried by said bow, comprising:

using an extension attachable to said bow to support and locate said quiver, said extension having a first portion configured for attachment to the bow and a second portion for supporting said quiver; and configuring said extension to locate said second portion in a position more closely adjacent the plane of bowstring motion than said first portion, whereby the off-plane loading effects of said quiver are minimized and vibration and torque correspondingly reduced when an arrow is shot from the bow.

14. The method of claim 13, wherein said extension is configured so as to locate said quiver closely adjacent said bow.

15. The method of claim 13, wherein said extension is configured so as to locate said quiver behind said bow and on the same side thereof as said bowstring.

16. The method of claim 15, wherein said extension is configured so as to locate said quiver closely adjacent said bow.

* * * * *